US005254427A

United States Patent [19]

Lane et al.

[11] Patent Number: 5,254,427

[45] Date of Patent: Oct. 19, 1993

[54] ADDITIVES FOR LIQUID ELECTROSTATIC DEVELOPERS

[75] Inventors: Gregg A. Lane, San Diego, Calif.; William A. Houle, Flatrock, N.C.; Loretta A. G. Page, Newark, Del.

[73] Assignee: Xerox Corporation, Stamford, Conn.

[21] Appl. No.: 814,549

[22] Filed: Dec. 30, 1991

[51] Int. Cl.[5] ..... G03G 9/12

[52] U.S. Cl. ..... 430/137; 430/114

[58] Field of Search ..... 430/114, 115, 137

[56] References Cited

U.S. PATENT DOCUMENTS

| | | | |
|---|---|---|---|
| 3,053,688 | 9/1962 | Grieg | 117/37 |
| 3,150,976 | 9/1964 | Johnson | 96/1 |
| 3,579,451 | 5/1971 | Sciambi | 252/62.1 |
| 3,852,208 | 12/1974 | Nagashima et al. | 430/115 |
| 3,933,664 | 1/1976 | Nagashima et al. | 252/62.1 |
| 3,939,087 | 2/1976 | Vijayendran et al. | 252/62.1 |
| 4,019,911 | 4/1977 | Vijayendran et al. | 106/23 |
| 4,314,013 | 2/1982 | Chang | 430/37 |
| 4,430,408 | 2/1984 | Sitaramiah | 430/106.6 |
| 4,476,210 | 10/1984 | Croucher et al. | 430/114 |
| 4,524,119 | 6/1985 | Luly et al. | 430/108 |
| 4,702,985 | 10/1987 | Larson | 430/115 |
| 4,707,429 | 11/1987 | Trout | 430/115 |
| 4,737,432 | 4/1988 | Tanaka et al. | 430/110 |
| 4,740,444 | 4/1988 | Trout | 430/137 |
| 4,760,009 | 7/1988 | Larson | 430/137 |
| 4,762,764 | 8/1988 | Ng et al. | 430/115 |
| 4,770,968 | 9/1988 | Georges et al. | 430/108 |
| 4,780,388 | 10/1988 | Larson | 430/115 |
| 4,820,604 | 9/1989 | Manca et al. | 430/110 |
| 4,876,169 | 10/1989 | Gruber et al. | 430/110 |
| 4,923,778 | 5/1990 | Blair et al. | 430/137 |
| 4,945,020 | 7/1990 | Kempf et al. | 430/49 |
| 4,966,825 | 10/1990 | Suzuki et al. | 430/114 |
| 5,019,477 | 5/1991 | Felder | 430/115 |
| 5,026,621 | 6/1991 | Tsubuko et al. | 430/109 |
| 5,030,535 | 7/1991 | Drappel et al. | 430/116 |
| 5,034,299 | 7/1991 | Houle et al. | 252/62.1 |
| 5,035,972 | 7/1991 | El-Sayed et al. | 430/114 |
| 5,116,705 | 5/1992 | Materazzi | 430/115 |

*Primary Examiner*—John Goodrow

*Attorney, Agent, or Firm*—Oliff & Berridge

[57] ABSTRACT

A liquid developer is prepared from a liquid electrostatic developer concentrate comprising up to 80% toner solids and a surfactant. The liquid electrostatic developer concentrate may be prepared by preparing a liquid electrostatic developer containing up to 20% toner solids; subsequently adding a surfactant to the liquid electrostatic developer; and concentrating the liquid electrostatic developer. The surfactant permits the easy redispersion of the toner solids at the time of use.

26 Claims, No Drawings

ADDITIVES FOR LIQUID ELECTROSTATIC DEVELOPERS

This invention is directed to a liquid developer concentrate and, in particular, to additives for liquid electrostatic developers which enable the redispersion of high toner solids developer concentrate.

BACKGROUND OF INVENTION

A latent electrostatic image can be developed with toner particles dispersed in an insulating non-polar liquid. Such dispersed materials are known as liquid developers. A latent electrostatic image may be produced by providing a photoconductive layer with a uniform electrostatic charge and subsequently discharging the electrostatic charge by exposing it to a beam of radiant energy. Other methods are also known for forming latent electrostatic images such as, for example, providing a carrier with a dielectric surface and transferring a preformed electrostatic charge to the surface. After the latent image has been formed, the image is developed by toner particles dispersed in a non-polar liquid. The image may then be transferred to a receiver sheet.

Useful liquid toners comprise thermoplastic resin toner particles and a dispersant non-polar liquid. Generally, a suitable colorant, such as a dye or pigment, is present in the toner particles. The colored toner particles are dispersed in a non-polar liquid which generally has a high volume resistivity in excess of $10^9$ ohm-centimeters, a low dielectric constant (i.e. below 3.0) and a high vapor pressure. Generally, the toner particles are less than 30 μm average by area size as measured using the Malvern 3600E particle sizer.

Liquid developers are typically produced as 10–20% by weight solids concentrate. However, liquid developers which are particularly useful are those with high solids content, because the carrier liquid which is contained within the machine tends to build up as developer containing a high percentage of carrier liquid is added. The more concentrated the developer used initially, the less carrier liquid builds up in the machine. Liquid which builds up in the machine must be disposed of as chemical waste, which is undesirable and inconvenient for the user.

U.S. Pat. No. 5,019,477 to Felder discloses a liquid electrostatic developer comprising a non-polar liquid, thermoplastic resin particles, and a charge director. The thermoplastic resin particles comprise a mixture of: (1) a polyethylene homopolymer or a copolymer of (i) polyethylene and (ii) acrylic acid, methacrylic acid or alkyl esters thereof, wherein (ii) comprises 0.1–20 weight percent of the copolymer; and (2) a random copolymer of (iii) selected from the group consisting of vinyltoluene and styrene and (iv) selected from the group consisting of butadiene and acrylate. As the copolymer of polyethylene and methacrylic acid or methacrylic acid alkyl esters, Nucrele® may be used.

U.S. Pat. Nos. 3,852,208 and 3,933,664, both to Nagashima et al., disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ball-mill, a roll-mill or an atomizer to produce a toner for use as a dry or wet developing agent, or may be used in combination with other colored substances or vehicle resins.

U.S. Pat. No. 4,524,119 to Luly et al. discloses dry electrophotographic development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid-repelling and solvent-soluble properties.

U.S. Pat. No. 5,030,535 to Drappel et al. discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C.–120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 4,762,764 to Ng et al. and U.S. Pat. No. 4,476,210 to Croucher et al. disclose a liquid developer comprising an amphipathic stabilizer polymer irreversibly anchored to a thermoplastic resin core of marking particles. The stabilizer has a soluble polymer backbone with an insoluble anchoring chain grafted onto the polymer backbone. The stabilizer may comprise an AB or ABA type block copolymer. The block copolymers may include siloxanes. The procedure for preparing the liquid developer comprises the steps of: (1) preparation of the amphipathic stabilizer; (2) non-aqueous dispersion polymerization of the core monomer in the presence of the amphipathic stabilizer to provide stabilized particles; (3) dyeing of the non-aqueous dispersion particles; and (4) negatively charging the particles.

A need continues to exist for an extended range of liquid developers with the desirable property of preventing fluid buildup in the machine and easy redispersion of toner solids at the time of use.

SUMMARY OF THE INVENTION

It is an object of the present invention to provide a liquid developer concentrate containing a high toner solids content which can be easily redispersed.

It is a further object of the invention to provide a liquid developer concentrate which eliminates the need for frequent disposal of liquid from the machine.

These and other objects are achieved by a liquid developer concentrate of the present invention wherein surfactants are included to facilitate redispersion of a high solids content in the toner. Preferred surfactants include polyakylsiloxane, polyether surfactants and AB block copolymers containing amino sites.

DETAILED DESCRIPTION OF PREFERRED EMBODIMENTS

The present invention provides a liquid electrostatic developer concentrate comprising a non-polar liquid, more than 20% toner solids and a surfactant. The present invention also provides a method of preparing a liquid electrostatic developer concentrate comprising the steps of: preparing a liquid electrostatic developer containing up to 20%, preferably about 10% to about 20%, by weight toner solids; subsequently adding a surfactant to the concentrated liquid electrostatic developer; and further concentrating the liquid electrostatic developer to about 35–95%, preferably greater than 50%, more preferably about 80%, by weight toner solids.

In this invention, the developer is prepared initially to a concentration of up to about 20% toner solids in any manner known by those skilled in the art, such as that disclosed in U.S. Pat. No. 5,019,477 to Felder. They are then further concentrated to a concentration up to about 95% toner solids (by weight) after the addition of surfactants. These materials act to coat the surface of the particles so that intimate particle-particle contact is not obtained upon concentration. Particle-particle contact leads to a high amount of force holding the particles together so that they cannot be easily redispersed (e.g., similar to clay, wherein once the clay is dried, it is difficult to redisperse the particles that make up the clay). It is essential to the efficient functioning of a liquid developer concentrate of the invention that the toner solids be able to be easily redispersed when the liquid developer is used to prepare an electrostatographic image.

The surfactants are preferably added after producing the liquid developer concentrates and before further concentration above about 20% by weight toner solids. The surfactants used are preferably in liquid form, although soluble solids would suffice. They must be soluble in the carrier liquid. They are preferably used in an amount of 0.01 to 1.0 gram of surfactant, more preferably 0.05 to 0.25 gram of surfactant, per gram of toner solids.

The surfactant is preferably selected from among polyalkylsiloxanes, polyether surfactants and AB block copolymers containing amino sites.

Exemplary polyalkylsiloxanes include polydimethylsiloxane, polydimethylsiloxaneaminopropyldimethyl terminated, polydimethylsiloxanecarbinol terminated, polymethylethylsiloxane, polymethylhexylsiloxane, polymethyloctadecylsiloxane, polymethyltetradecylsiloxane, polymethylhexadecylsiloxane, polymethylcyclohexylsiloxane and polyethylsilicates of the formula:

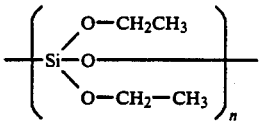

Exemplary polyether surfactants include octylphenoxypolyethoxy ethanol, nonylphenoxypolyethoxy ethanol, oxiranemethyl polymer with oxirane mono(octylphenyl) ether branched and octylbenyzl polyether. Preferred are alkylphenoxy polyethoxy ethanols, such as octylphenoxy polyethoxy ethanol (Triton ®X-35 from Rohm and Haas Co.) of the formula:

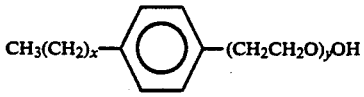

x = 3–18
y = 5–10

Exemplary AB block copolymers containing amino sites include poly(N,N-dimethylamino)-2-ethyl methacrylate-copoly-2-ethylhexyl methacrylate, poly(N,N-dimethylamino)-2-ethyl methacrylate-co-poly-2-lauryl methacrylate, poly(N,N-diethylamino)-2-ethyl methacrylate-co-poly-2-ethylhexyl methacrylate, poly(N,N-dimethylamino)-2-ethyl methacrylate-co-poly-2-n-octyl methacrylate, poly(N,N-dimethylamino)-2-ethyl methacrylate-co-poly-2-stearyl methacrylate, poly(N,N-diethylamino)-2-ethyl methacrylateco-poly-2-lauryl methacrylate, polyvinylpyridine-co-poly-2-ethylhexyl acrylate and polyaminostyrene-copolybutadiene. Preferred copolymers include AB amine, provided by Polymer Products Department, E. I. du Pont de Nemours and Company, of the formula:

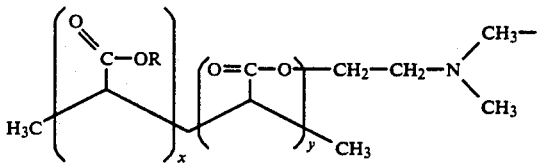

x = 30 y = 8

The AB block copolymer of this example is comprised of an ethylhexyl methacrylate segment and a dimethylaminomethylmethacrylate segment.

After a material as described above has been added to the toner containing 10-20% toner solids, carrier liquid is removed while leaving behind the surfactant to form the liquid developer concentrate.

The basic liquid developer may be obtained commercially or prepared by methods known in the art. For example, the liquid developer may be initially prepared from at least one thermoplastic polymer or resin, suitable colorants and hydrocarbon dispersant liquids as described in more detail below. Additional components can be added, e.g., charge director, adjuvants, and the like as is well known in the art.

The liquid carrier of the claimed invention is a nonpolar liquid having a kauri-butanol value of less than 30, and is employed as a dispersant in the present invention. Preferably it is a branched-chain aliphatic hydrocarbon.

More particularly, a non-polar liquid of the Isopar® series may be used in the present developers. These hydrocarbon liquids are narrow cuts of isoparaffinic hydrocarbon fractions with extremely high levels of purity. For example, the boiling range of Isopar®G is between 157° C. and 176° C.; Isopar®H is between about 176° C. and 191° C. Isopar®K is between about 177° C. and 197° C.; Isopar®L is between 188° C. and 206° C.; Isopar®M is between 207° C. and 254° C. and Isopar®V is between 254.4° C. and 329.4 C. Isopar®L has a mid-boiling point of approximately 194° C. Isopar®M has an auto ignition temperature of 338° C. Isopar®G has a flash point of 40° C. as determined by the tag closed cup method; Isopar®H has a flash point of 53° C. as determined by the ASTM D-56 method; Isopar®L has a flash point of 61° C. as determined by the ASTM D-56 method and Isopar®M has a flash point of 80° C. as determined by the ASTM D-56 method and an auto-ignition temperature of 338° C. They are substantially odorless, possessing only a very mild paraffinic odor. They have excellent odor stability and are all manufactured by the Exxon Corporation. High-purity normal paraffinic liquids, such as Norpar®12, Norpar®13 and Norpar®15 (Exxon Corporation), may also be used. They have flash points of 69° C., 93° C. and 118° C., respectively, and have auto-ignition temperatures of 204° C., 210° C. and 210° C., respectively.

Additional useful hydrocarbon liquids include Aromatic®100, Aromatic®150 and Aromatic®200, manufactured by Exxon Corporation. These liquid hydrocarbons have a kauri-butanol value of less than 30, as determined by ASTM D1133; flash points of 43° C., 66° C. and 103° C. respectively, as determined by ASTM D56; and vapor pressures (kPa at 38° C.) of 1.7, 0.5 and 0.17 respectively, as determined by ASTM 2879.

All of the dispersant liquids in the present invention should have an electrical volume resistivity in excess of $10^9$ ohm-centimeters and a dielectric constant below 3.0. Moreover, the vapor pressure at 25° C. should be less than 10 torr.

While the Isopar® series are the preferred non-polar liquids for use as dispersants in the present liquid developers, the essential characteristics of all suitable non-polar liquids is the kauri-butanol value. Specifically, the non-polar liquids employed in the present liquid electrostatic developers have a kauri-butanol value of about 25 to about 30, and preferably about 27 to 28, as determined by the ASTM D-1136 method.

The kauri-butanol value can be defined as a measure of the aromatic content (and hence, the solvent power) of a hydrocarbon liquid. The kauri-butanol value is a measure of the volume of solvent required to produce turbidity in a standard solution containing kauri gum dissolved in butanol. Kauri gum is readily soluble in butanol but insoluble in hydrocarbons. Accordingly, low kauri-butanol values represent non-polar aliphatic solvents with high dielectric constants and low volume resistivities.

Thermoplastic resins which may be employed in the toner of the liquid developer of the present invention include ethylene vinyl acetate (EVA) copolymers (Elvax® resins, E. I. du Pont de Nemours and Company, Wilmington, Del.) , copolymers of ethylene and an $\alpha$-$\beta$-ethylenically unsaturated acid selected from the class consisting of acrylic acid and methacrylic acid, copolymers of ethylene (80–99.9%) acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural by Union Carbide Corp., Stamford, Conn., ethylene vinyl acetate resins, e.g., DQDA 6832 Natural 7 also sold by Union Carbide Corp. ; Surlyn® ionomer resin by E. I. Du Pont de Nemours and Company, Wilmington, Del., blends thereof, polyesters, polyvinyl toluene, polyamides, styrene/butadiene copolymers, epoxy resins acrylic resins, such as a copolymer of acrylic or methacrylic acid and at least one alkyl ester of acrylic or methacrylic acid wherein alkyl is 1 to 20 carbon atoms, e.g., methyl methacrylate (50 to 90%)/methacrylic acid (0 to 20%) /ethylhexyl acrylate (10 to 50%) ; and other acrylic resins including Elvacite® Acrylic Resins, E. I. du Pont de Nemours and Company, Wilmington, Del., or blends of the resins. Preferred copolymers are the copolymer of ethylene and an $\alpha$-$\beta$-ethylenically unsaturated acid of either acrylic acid or methacrylic acid. In a preferred embodiment, Nucrels is used as the thermoplastic resin. Other commercially available toner resins for liquid developers may also be used.

An advantage of the present invention is that it may be applied to commercially available liquid developer by adding surfactant to, and then concentrating, them. Suitable available developers are, described in U.S. Pat. Nos. 4,702,985; 4,707,429; 4,746,444; and 4,760,009, which are hereby incorporated by reference.

One or more charge directors known to those skilled in the art can be added to impart a charge, as desired. Suitable non-polar liquid soluble ionic or zwitterionic charge director compounds, which are generally used in an amount of 0.25 to 1,500 mg/g, preferably 2.5 to 400 mg/g of toner solids, include: negative charge directors, e.g., lecithin, Basic Calcium Petronate®, Basic Barium Petronate®, Neutral Barium Petronate®, oil-soluble petroleum sulfonate, manufactured by Sonneborn division of Witco Chemical Corp., New York, N.,Y., alkyl succinimide (manufactured by Chevron Chemical company of California) etc.; positive charge directors, e.g. sodium dioctylsulfo succinate (manufactured by American Cyanamid Co.); ionic charge directors such as zirconium octoate, copper oleate, iron naphthenate, etc.; nonionic charge directors, e.g., polyethylene glycol sorbitan stearate, nigrosine, triphenyl methane type dyes and Emphos®D70-30 C. and Emphos® F-27-85 sold by Witco Chem. Corp., N.Y., N.Y., sodium salts of phosphated mono- and diglycerides with unsaturated and saturated acid substituents, respectively.

The liquid developer of the present invention may optionally contain a colorant dispersed in the resin particles. Colorants, such as pigments or dyes and combinations thereof, are preferably present to render the latent image visible. The colorant should be insoluble in the liquid carrier.

The colorant may be present in the developer in an amount of from about 0.1 to about 60 percent, and preferably from about 1 to about 30 percent by weight based on the total weight of solids contained in the developer. The amount of colorant used may vary depending on the use of the developer. Examples of pigments which may be used in the present developers include those set forth below.

| Pigment Brand Name | Manufacturer | Color |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chem. | Yellow 14 |
| L75-1331 Yellow | Sun Chem. | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| L75-2337 Yellow | Sun Chem. | Yellow 83 |
| Cromophthal ® Yellow 3G | Ciba-Geigy | Yellow 93 |
| Cromophthal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophthal ® Yellow 8G | Ciba-Geigy | Yellow 128 |
| Irgazine ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue TBD 7010 | BASF | Blue:3 |
| Heliogen ® Blue K 7090 | BASF | Blue 15:3 |
| Heliogen ® Blue L 7101F | BASF | Blue 15:4 |
| Heliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet | Ciba-Geigy | Violet 19 |
| Monastral ® Red | Ciba-Geigy | Violet 19 |
| Quindo ® Red 6700 | Mobay | Violet 19 |
| Quindo ® Red 6713 | Mobay | Violet 19 |
| Indofast ® Violet | Mobay | Violet 19 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L 77266 | Cabot | Black, CI |
| Uhlich ® BK 8200 | Paul Uhlich | Black |

Other ingredients, known as adjuvants, may be added to the electrostatic liquid developer. For example, fine particle size oxides, e.g., silica, alumina, titania, etc., preferably in a particle size on the order of 0.8 μm or less, can be dispersed into the liquefied resin in the toner. These oxides can be used alone or in combination with the colorant. Metal particles can also be added.

Another optional additional component of the electrostatic liquid developer is an adjuvant which can be taken from the group of polyhydroxy compounds, aminoalcohol, polybutylene succinimides, metallic soaps and aromatic hydrocarbons having a kauri-butanol value of greater than 30. These adjuvants are generally used in an amount of 1 to 1000 mg/g, preferably 1 to 200 mg/g of developer solids. Examples of the various above-described adjuvants include:

A) polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glyceroltri-12 hydroxystearate, ethylene glycol monohydroxystearate, propylene glycerol monohydroxy-stearate;

B) aminoalcohol compounds: triisopropanolamine, triethanolamine, ethanolamine, 3-amino-i-propanol, o-aminophenol, 5-amino-1-pentanol, tetra(2-hydroxyethyl)ethylenediamine;

C) polybutylene/succinimide: OLOA ®-1200 sold by Chevron Corp.; Amoco 575 having a number average molecular weight of about 600 (vapor pressure osmometry) made by reacting maleic anhydride which in turn is reacted with a polyamine (Amoco 575 is 40 to 45% surfactant, 364 aromatic hydrocarbon, and the remainder oil);

D) metallic soaps: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates;

E) aromatic hydrocarbons: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_{90}$ and $C_{10}$ alkyl-substituted benzenes manufactured by Exxon Corp.

If a colorant and/or any adjuvants are to be used in the present liquid developer, these ingredients should be mixed directly with the resin so that the colorant and/or adjuvants may be dispersed directly and uniformly into the resin particles.

The invention will further be illustrated in the following non-limiting examples, it being understood that these examples are intended to be illustrative only and that the invention is not intended to be limited to the materials, conditions, process parameters and the like recited herein.

Developer Preparation 1

A magenta toner is prepared by adding 298 grams of a copolymer of ethylene (91%) and methacrylic acid (9%) (melt index at 190° C. is 500; Acid No. is 60); 52.5 grams of a magenta pigment NBD 4559 (BASF, Holland, Mich.); and 817 grams of Isopar ®L (Exxon Corporation) to a Union Process IS attritor (Union Process Company, Akron, Ohio) charged with 0.1847 inch (4.76 mm) diameter carbon steel balls. The mixture is milled at 100° C. for 1 hour and then cooled to 25° C. 833 grams of Isopar ®L are added and the mixture is milled for another 4 hours. An additional 917 grams of Isopar ®L are added to bring the percent solids to 12%. The particle size is 4.7 microns V(50) and 11.1 microns V(90) as measured with a Malvern 3600E particle size analyzer.

Developer Preparation 2

An unpigmented toner is prepared by adding 350 grams of a copolymer of ethylene (91%) and methacrylic acid (9%) (melt index at 190° C. is 500, Acid No. is 60) and 817 grams of Isopar ®L to a Union Process 1S attritor charged with 0.1857 inch (4.76 mm) diameter carbon steel balls. The mixture is milled at 100° C. for 1 hour and then cooled to 250C. 833 grams of Isopar ®L are added and the mixture is milled for another 4 hours. An additional 917 grams of Isopar ®L are added to bring the percent solids to 12%. The particle size is 8.8 microns V(50) and 17.0 microns V(90) as measured with a Malvern 3600E particle size analyzer.

Developer Preparation 3

A cyan toner is prepared by adding 257 grams of a terpolymer of methyl methacrylate (67%), methacrylic acid (3%) and ethylhexylacrylate (30%) (Acid No. is 13), 64 grams of a cyan pigment NBD 7010 (BASF, Holland, Mich.) and 1284 grams of Isopar®L to a Union Process 1S attritor charged with 0.1857 inch (4.76 mm) diameter carbon steel balls. The mixture is milled at 100° C. for 1 hour and then cooled to 20° C. 535 grams of Isopar®L are added and the mixture is milled for another 4 hours. An additional 535 grams of Isopar®L are added to bring the percent solids to 12%. The particle size is 4.3 microns V(50) and 8.0 microns V(90) as measured with a Malvern 3600E particle size analyzer.

Control 1

Four thirty gram samples of toner at 10% in Isopar® from Developer Preparation 1 are spun down in an International Clinical centrifuge, Model CL at a speed setting of 7 for 10 minutes. The supernatant is discarded and the weight is brought up to 30 grams with hexane. The toner particles are resuspended by vigorous shaking, centrifuged, and the supernatant is again discarded and replaced with hexane. This sample is centrifuged again, the supernatant is removed, the remaining toner is collected, and the hexane is removed by air drying to 464 solids. This procedure is repeated with one or two additional hexane replacement steps to yield developer at 69% and 944 solids after air drying to remove the hexane. Thirty gram samples are prepared from these concentrates such that the percent solids is 1% in Isopar®L. The samples are homogenized on an omni Homogenizer Model 17505 with a 15401 generator at a speed setting of 6. Samples, are taken at 0.5. 1, 3, and 6 minutes for particle size analysis. The particle size distributions of the concentrated and redispersed toner are measured with a Malvern 3600E particle size analyzer. Data is presented in the table below.

Control 2

The procedure of Control 1 is followed with Developer Preparation 2. Three spin down cycles in hexane are used to achieve a final percent solids of 88% after air drying to remove the hexane. Particle size distributions after the redispersion procedure of Control 1 are set forth below.

Control 3

The procedure of Control 1 is followed with Developer Preparation 3. Three spin down cycles in hexane are used to achieve a final percent solids of 95% after air drying to remove the hexane. Particle size distributions after the redispersion procedure of Control 1 with the homogenizer run at speed settings of 3 and 6 are set forth below.

EXAMPLE 1

Developer Preparation 1 is prepared as per the procedure in Control 1 with the following exceptions. After three solvent replacement cycles, 0.3 grams of a PS040 (Petrarch Huls, Bristol, Pa.), a polydimethyl siloxane of MW 3780, is added with sufficient hexane to bring the sample weight up to 30 grams. After vigorous shaking to mix, the sample is filtered on a Buchner funnel under light vacuum to remove excess solvent and allowed to air dry to 94% solids. Redispersion is carried out as per Control 1. Particle size distribution versus redispersion time is indicated in the table below. As can be seen from the table, and acceptable particle size distribution is achieved in a relatively short period of time compared to Control 1.3 which would not redisperse under these conditions.

EXAMPLE 2

Developer from Preparation 1 is prepared as per the procedure in Control 1 with the following exceptions. After two solvent replacement cycles, 0.75 grams of a PS035 (Petrarch Huls, Bristol, Pa.), a polydimethyl siloxane of MW 237 is added with sufficient hexane to bring the sample weight up to 30 grams. After vigorous shaking to mix, the sample is filtered on a Buchner funnel under light vacuum to remove excess solvent and allowed to air dry to 46% solids. Redispersion is as per Control 1 except at a lower speed of 3. Particle size distribution versus redispersion time is indicated in the table below. As can be seen from the table, an acceptable particle size distribution is achieved with less energy compared to the control 1.1 developer redispersed under the otherwise same conditions from the same percent solids.

EXAMPLE 3

Developer Preparation 1 is prepared as per the procedure in Control 1 with the following exceptions. After two solvent replacement cycles, 0.75 grams of a PS061 (Petrarch Huls, Bristol, Pa.), a (90%) dimethyl—(10%) methylphenyl siloxane of MW 1550, is added with sufficient hexane to bring the sample weight up to 30 grams. After vigorous shaking to mix, the sample is filtered on a Buchner funnel under light vacuum to remove excess solvent and allowed to air dry to 79% solids. Redispersion is as per Control 1. Particle size distribution versus redispersion time is indicated in the table below. As can be seen from the table, an acceptable particle size distribution is achieved in a shorter period of time compared to the control 1.2 developer redispersed under the same conditions from a similar percent solids.

EXAMPLE 4

Developer Preparation 1 is prepared as per the procedure in Control 1 with the following exceptions. After two solvent replacement cycles, 0.75 grams of a PS140 (Petrarch Huls, Bristol, Pa.), a methyl/octyl siloxane of MW 6200, is added with sufficient hexane to bring the sample weight up to 30 grams. After vigorous shaking to mix, the sample is filtered on a Buchner funnel under light vacuum to remove excess solvent and allowed to air dry to 66% solids. Redispersion is as per Control 1. Particle size distribution versus redispersion time is indicated in the table below. As can be seen from the table, an acceptable particle size distribution is achieved in a shorter period of time compared to the Control developer redispersed under the same conditions.

EXAMPLE 5

Developer Preparation 2 is prepared with the dimethylsiloxane PS040 (Petrarch Huls, Bristol, Pa.) as per the procedure in Example 1 to yield a final percent solids of 884. Redispersion is as per Control 2. As can be seen from the table, an acceptable particle size distribution is achieved in a shorter period of time compared to the Control 2 developer redispersed under the same conditions from a similar percent solids.

EXAMPLE 6

Developer Preparation 3 is prepared with the dimethylsiloxane PS040 (Petrarch Huls, Bristol, Pa.) as per the procedure in Example 1 to yield a final percent solids of 92%. Redispersion is as per control 3. As can be seen from the table, an acceptable particle size distribution is achieved in a shorter period of time compared to the Control 3 developer redispersed under the same conditions from a similar percent solids.

| Example (concentrate) | Homogenizer Speed | | Particle Size (Malvern) (μ) Redispersion 0.5 min | Time 1 min | 3 min | 6 min |
|---|---|---|---|---|---|---|
| Control 1.1 | 6 | V(50) | 5.5 | 5.1 | 5 | 5 |
| 46% | | V(90) | 14.5 | 10.6 | 9.3 | 8.9 |
| Control 1.2 | 6 | V(50) | 7.4 | 7 | 6.5 | 6.3 |
| 69% | | V(90) | 40.2 | 38.2 | 18 | 13.5 |
| Control 1.3 | 6 | V(50) | would not redisperse | | | |
| 94% | | V(90) | large agglomerates visible to the eye | | | |
| Control 2 | 6 | V(50) | 10.3 | 9.7 | 10.2 | 10.4 |
| 89% | | V(90) | 38.5 | 30.8 | 38.7 | 41.2 |
| Control 3 | 3 | V(50) | 8.5 | 8.3 | 7.8 | 6.5 |
| 95% | | V(90) | 68.1 | 67 | 55.2 | 40.1 |
| | 6 | V(50) | 6.5 | 7 | 6.6 | 6.9 |
| | | V(90) | 40.5 | 34.6 | 19.6 | 15.6 |
| Example 1 | 6 | V(50) | 8.4 | 7.8 | 6.6 | 6.1 |
| 94% | | V(90) | 56.7 | 50.6 | 28.9 | 13.6 |
| Example 2 | 3 | V(50) | 5.6 | 5.4 | 5.1 | 4.9 |
| 45% | | V(90) | 17.9 | 13.3 | 10.2 | 8.9 |
| Example 3 | 6 | V(50) | 7.5 | 7.2 | 6.4 | 6.2 |
| 79% | | V(90) | 48.8 | 28.7 | 15.7 | 13.9 |
| Example 4 | 6 | V(50) | 6.1 | 6.3 | 5.5 | 5.4 |
| 66% | | V(90) | 14.3 | 13.7 | 10.3 | 10.1 |
| Example 5 | 6 | V(50) | 13.7 | 11.4 | 9.9 | 9.3 |
| 88% | | V(90) | 48.1 | 37.1 | 23.6 | 20.9 |
| Example 6 | 3 | V(50) | 8.8 | 8.5 | 7.3 | 6.9 |
| 92% | | V(90) | 69.3 | 65 | 30 | 19.4 |
| | 6 | V(50) | 7 | 6.3 | 5.9 | 6 |
| | | V(90) | 39 | 22.2 | 14 | 12.2 |

While the invention has been described with reference to particular preferred embodiments, the invention is not limited to the specific examples given, and other embodiments and modifications can be made by those skilled in the art without departing from the spirit and scope of the invention.

What is claimed is:

1. A method of preparing a liquid electrostatic developer concentrate, comprising the steps of:

preparing a liquid electrostatic developer which contains up to 20% toner solids;

adding a surfactant to said liquid electrostatic developer; and further concentrating said liquid electrostatic developer to a concentration of up to about 35%–95% toner solids.

2. The method of claim 1, wherein said surfactant is selected from the group consisting of polyalkylsiloxane, polyether surfactants and AB block copolymers containing amino sites.

3. The method of claim 2, wherein said polyalkylsiloxane is selected from the group consisting of polymethylsiloxane, polydimethylsiloxaneaminopropyldimethyl terminated, polydimethylsiloxanecarbinol terminated, polymethylethylsiloxane, polymethylhexylsiloxane, polymethyloctadecylsiloxane, polymethyltetradecylsiloxane, polymethylhexadecylsiloxane, polymethylcyclohexylsiloxane and polyethylsilicate.

4. The method of claim 2, wherein said polyether surfactant is selected from the group consisting of octylphenoxypolyethoxy ethanol, nonylphenoxypolyethoxy ethanol, oxiranemethyl polymer with oxirane mono(octylphenyl) ether branched and octylbenyzl polyether.

5. The method of claim 2, wherein said AB block copolymer is selected from the group consisting of poly(N,N-dimethylamino)-2-ethyl methacrylate-co-poly-2-ethylhexyl methacrylate, poly(N,N-dimethylamino)-2-ethyl methacrylate-co-poly-2-lauryl methacrylate, poly(N,N-diethylamino)-2-ethyl methacrylate-co-poly-2-ethylhexyl methacrylate, poly(N,N-dimethylamino)-2-ethyl methacrylate-co-poly-2-n-octyl methacrylate, poly(N,N-dimethylamino)-2-ethyl methacrylate-co-poly-2-stearyl methacrylate, poly(N,N-diethylamino)-2-ethyl methacrylate- co-poly-2-lauryl methacrylate, polyvinylpyridine-co-poly-2-ethylhexyl acrylate and polyaminostyrene-copolybutadiene.

6. The method of claim 5, wherein said AB block copolymer comprises an ethylhexyl methacrylate segment and a dimethylaminomethylmethacrylate segment.

7. The method of claim 1, wherein said surfactant is soluble in a non-polar liquid carrier of said developer.

8. The method of claim 1, wherein the concentration of said surfactant is about 0.01 to about 1.0 gram of surfactant per gram of toner solids in said developer 9. The method of claim 1, wherein the concentration of said surfactant is about 0.05 to bout 0.25 gram of surfactant per frame of toner solids in said developer.

10. A liquid electrostatic developer concentrate comprising a non-polar insulating liquid, more than 50% of toner solids and a surfactant.

11. The liquid electrostatic developer concentrate of claim 10 wherein said surfactant is selected from the group consisting of polyalkylsiloxane, polyether surfactants and AB block copolymers containing amino sites.

12. The liquid electrostatic developer concentrate of claim 11, wherein said polyalkylsiloxane is selected from the group consisting of polymethylsiloxane, polydimethylsiloxane-aminopropyldimethyl terminated, polydimethylsiloxane-carbinol terminated, polymethylethylsiloxane, polymethylhexylsiloxane, polymethyloctadecylsiloxane, polymethyltetradecylsiloxane, polymethylhexadecylsiloxane, polymethylcyclohexylsiloxane and polyethylsilicate.

13. The liquid electrostatic developer concentrate of claim 11, wherein said polyether surfactant is selected from the group consisting of octylphenoxypolyethoxy ethanol, nonylphenoxypolyethoxy ethanol, oxiranemethyl polymer with oxirane mono(octylphenyl) ether branched and octylbenyzl polyether.

14. The liquid electrostatic developer concentrate of claim 11, wherein said AB block copolymer is selected from the group consisting of poly(N,N-dimethylamino)-2-ethyl methacrylate-co-poly-2-ethylhexyl methacrylate, poly(N,N-dimethylamino)-2-ethyl methacrylate-co-poly-2-lauryl methacrylate, poly(N,N-diethylamino)-2-ethyl methacrylate-co-poly-2-ethylhexyl methacrylate, poly(N,N-dimethylamino)-2-ethyl methacrylate-co-poly-2-n-octyl methacrylate, poly(N,N-dimethylamino)-2-ethyl methacrylate-co-poly-2-stearyl methacrylate, poly(N,N-diethylamino)-2-ethyl methacrylateco-poly-2-lauryl methacrylate, polyvinylpyridine-co-poly-2-ethylhexyl acrylate, and polyaminastyrene-copolybutadiene.

15. The liquid electrostatic developer concentrate of claim 14 wherein said AB block copolymer comprises an ethylhexyl methacrylate segment and a dimethylaminomethylmethacrylate segment.

16. The liquid electrostatic developer concentrate of claim 10, wherein said concentrate contains from about 50% to about 95% toner solids.

17. The liquid electrostatic developer concentrate of claim 10, wherein said concentrate contains from about 50% to about 85% toner solids.

18. The liquid electrostatic developer concentrate of claim 10, wherein said concentrate contains from about 70% to about 80% toner solids.

19. The liquid electrostatic developer concentrate of claim 10, wherein the concentration of said surfactant is about 0.01 to about 1.0 gram of surfactant per gram of said toner solids.

20. The liquid electrostatic developer concentrate of claim 10 wherein the concentration of said surfactant is about 0.5 to about 0.25 gram of surfactant per gram of said toner solids.

21. A liquid electrostatic developer containing a surfactant selected from the group consisting of polyalkylsiloxane other than polydimethylsiloxane and polyether surfactants.

22. The liquid electrostatic developer of claim 21, wherein said polyalkylsiloxane is selected from the group consisting of polymethylsiloxane, polydimethylsiloxane-aminopropyldimethyl terminated, polydimethylsiloxane-carbinol terminated, polymethylethylsiloxane, polymethylhexylsiloxane, polymethyloctadecylsiloxane, polymethyltetradecylsiloxane, polymethylhexadecylsiloxane, polymethylcyclohexylsiloxane and polyethylsilicate.

23. The liquid electrostatic developer of claim 21, wherein said polyether surfactant is selected from the group consisting of octylphenoxypolyethoxy ethanol, nonylphenoxypolyethoxy ethanol, oxiranemethyl polymer with oxirane mono(octylphenyl) ether branched and octylbenyzl polyether.

24. A liquid electrostatic developer containing toner solids and an AB copolymer surfactant with amino sites, wherein said AB copolymer is present in an amount from about 0.01 gm to about 1 gm of toner solids in said developer.

25. The liquid electrostatic developer of claim 24, wherein said AB block copolymer is selected from the group consisting of poly(N,N-dimethylamino)-2-ethylmethacrylate-co-poly-2-ethylhexyl methacrylate, poly(N,N-dimethylamino)-2-ethyl methacrylate-co-poly-2-lauryl methacrylate, poly(N,N-diethylamino)-2ethyl methacrylateco-poly-2-ethylhexyl methacrylate, poly(N,N-dimethylamino)-2-ethyl methacrylate-co-poly-2-n-octyl methacrylate, poly(N,N-dimethylamino)-2-ethyl methacrylate-co-poly-2-stearyl methacrylate, poly(N,N-diethylamino)-2-ethyl methacrylate-co-poly-2-lauryl methacrylate, polyvinylpyridine-co-poly-2-ethylhexyl acrylate, and polyaminostyrene-co-polybutadiene.

26. The liquid electrostatic developer of claim 25, wherein said AB block copolymer comprises an ethylhexyl methacrylate segment and a dimethylaminomethylmethacrylate segment.

* * * * *